US010258211B2

(12) United States Patent
McLeod

(10) Patent No.: US 10,258,211 B2
(45) Date of Patent: Apr. 16, 2019

(54) FLOOR TOOL FOR A CLEANING APPLIANCE

(75) Inventor: David Andrew McLeod, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 1238 days.

(21) Appl. No.: 12/628,656

(22) Filed: Dec. 1, 2009

(65) Prior Publication Data

US 2010/0154150 A1 Jun. 24, 2010

(30) Foreign Application Priority Data

Dec. 19, 2008 (GB) ..... 0823191.2

(51) Int. Cl.
*A47L 9/00* (2006.01)
*A47L 9/02* (2006.01)

(52) U.S. Cl.
CPC ..... *A47L 9/009* (2013.01); *A47L 9/02* (2013.01)

(58) Field of Classification Search
CPC ..... A47L 5/00; A47L 5/12; A47L 5/28; A47L 5/32; A47L 5/36
USPC ..... 15/3, 415.1; 180/7.1, 21; 301/5.1
See application file for complete search history.

(56) References Cited

U.S. PATENT DOCUMENTS 2,967,580 A * 1/1961 Aghnides ..... 180/24.03
4,353,428 A * 10/1982 Kovar et al. ..... 180/7.1
4,519,466 A * 5/1985 Shiraishi ..... 180/7.1
4,564,972 A * 1/1986 Varin ..... 15/358
4,995,679 A * 2/1991 Segerljung ..... 301/5.1
5,497,532 A * 3/1996 Glatz ..... 15/401
5,564,161 A * 10/1996 Glatz ..... 15/415.1
6,230,363 B1 * 5/2001 Kawai et al. ..... 15/339
6,474,434 B1 * 11/2002 Bech ..... 180/252
6,536,073 B2 * 3/2003 Uratani et al. ..... 15/327.4
6,543,559 B1 * 4/2003 Kaplun ..... 180/7.1
6,561,591 B2 * 5/2003 Zimet ..... 301/5.1
6,896,078 B2 * 5/2005 Wakui ..... 180/7.1
7,069,620 B2 * 7/2006 Bagwell ..... 15/398
7,757,343 B2 * 7/2010 Courtney ..... 15/351
2001/0029641 A1 * 10/2001 Uratani et al. ..... 15/327.4
2001/0037536 A1 * 11/2001 Kim ..... 15/361
2002/0185907 A1 * 12/2002 Zimet ..... 301/5.1
2004/0182614 A1 * 9/2004 Wakui ..... 180/7.1
2006/0162119 A1 * 7/2006 Smith ..... 15/388
2006/0202548 A1 * 9/2006 Chen ..... 301/5.1
2007/0056667 A1 3/2007 Worwag
(Continued)

FOREIGN PATENT DOCUMENTS

GB 2 391 459 2/2004
GB 2391459 A * 2/2004 ..... A47L 5/00
(Continued)

OTHER PUBLICATIONS

International Search Report and Written Opinion dated Mar. 5, 2010, directed to corresponding International Patent Application No. PCT/GB2009/051546; 17 pages.
(Continued)

*Primary Examiner* — Tatiana Nobrega
(74) *Attorney, Agent, or Firm* — Morrison & Foerster LLP

(57) ABSTRACT

A floor tool for a cleaning appliance including a cleaner head rotatably attached to a conduit carried by a pair of wheels that converge beneath the conduit.

20 Claims, 3 Drawing Sheets

(56) References Cited

U.S. PATENT DOCUMENTS

| | | | | |
|---|---|---|---|---|
| 2007/0226937 | A1* | 10/2007 | Courtney | 15/246.4 |
| 2009/0089967 | A1* | 4/2009 | Yang et al. | 15/402 |
| 2009/0313786 | A1* | 12/2009 | Cookson | 15/415.1 |

FOREIGN PATENT DOCUMENTS

| | | | | |
|---|---|---|---|---|
| GB | 2 441 301 | | 3/2008 | |
| GB | 2441301 | A * | 3/2008 | A47L 9/00 |
| JP | 7-184809 | | 7/1995 | |
| WO | WO-2005/110179 | | 11/2005 | |
| WO | WO-2005/111084 | | 11/2005 | |

OTHER PUBLICATIONS

GB Search Report dated Mar. 19, 2009, directed to counterpart GB Application No. 0823191.2; 1 page.

* cited by examiner

FLOOR TOOL FOR A CLEANING APPLIANCE

REFERENCE TO RELATED APPLICATIONS

This application claims the priority of United Kingdom Application No. 0823191.2, filed Dec. 19, 2008, the entire contents of which are incorporated herein by reference.

FIELD OF THE INVENTION

The present invention relates to a floor tool for a cleaning appliance.

BACKGROUND OF THE INVENTION

Cleaning appliances, such as vacuum cleaners, floor polishers and shampoo machines, may include a hose-and-wand assembly to which different accessories may be attached. One such accessory is a floor tool which a user manoeuvres back and forth over a surface to be cleaned. The floor tool may include wheels which aid the user in manoeuvring the floor tool. However, there is often difficultly in manoeuvring the floor tool in directions beyond that of a straight line.

SUMMARY OF THE INVENTION

In a first aspect, the present invention provides a floor tool for a cleaning appliance comprising a cleaner head rotatably attached to a conduit carried by a pair of wheels that converge beneath the conduit, wherein the wheels have axes of rotation that intersect above a line passing through the wheel centres.

In a second aspect, the present invention provides a floor tool for a cleaning appliance comprising a cleaner head rotatably attached to a conduit carried by a pair of dome-shaped wheels, the wheels having axes of rotation that are oriented such that the wheels converge beneath the conduit.

In a third aspect, the present invention provides a floor tool for a cleaning appliance comprising a cleaner head rotatably attached to a conduit carried by two wheels only that converge beneath the conduit.

In each aspect, the conduit fluidly couples the cleaner head to the cleaning appliance such that fluid may be carried between the cleaning appliance and a surface to be cleaned. The free end of the conduit may be adapted for releasable attachment to a wand, hose or like duct of the cleaning appliance. Alternatively, the conduit may final an integral part of the cleaning appliance.

In converging beneath the conduit, the wheels rotate about axes of rotation that are oriented such that the separation between the wheels is smallest beneath the conduit. In providing convergent wheels, a space is defined between the two wheels through which the conduit can pass. Accordingly, the floor tool is supported by wheels that do not unduly increase the size, and in particular the height, of the floor tool.

By including a bend in the conduit, movement of the floor tool beyond that of a straight line is made possible by rotating the free end of the conduit. To facilitate steering of the floor tool, the conduit preferably comprises a forward portion that is pivotally attached to a rearward portion. The wheels are then rotatably attached to the forward portion, which is in turn rotatably attached to the cleaner head. This arrangement additionally helps to prevent the cleaner head being inadvertently lifted as the floor tool is manoeuvred over the cleaning surface. Advantageously, the rearward portion is attached to the forward portion at points above those at which the wheels are attached to the forward portion. Consequently, the length of the conduit may be kept to a minimum, resulting in a more compact floor tool.

The wheels are preferably dome-shaped. Accordingly, as the conduit rotates relative to the cleaner head, the wheels continue to provide a rolling support. Moreover, the wheels advantageously provide a substantially continuous arcuate support in the plane normal to the longitudinal axis of the conduit. Consequently, as the floor tool is steered in different directions, a smooth transition occurs as support moves from one wheel to the next. Indeed, in order that, from the point of the user, the transition between wheels feels continuous, the gap between the wheels preferably subtends an angle at the centre of the conduit of no more than 20 degrees. That is to say that, in the plane normal to the longitudinal axis of the conduit, the gap subtends an angle of no more than 20 degrees at the longitudinal axis of the conduit.

The surfaces of the wheels are preferably coincident with a common sphere. Moreover, the centre of the common sphere is ideally coincident with the longitudinal axis of the conduit. Consequently, as the conduit rotates relative to the cleaner head, the conduit maintains the same height above the cleaning surface. This then helps prevent lifting of the cleaner head as the floor tool is steered in different directions.

In order that the present invention may be more readily understood, embodiments of the invention will now be described, by way of example, with reference to the accompanying drawings, in which:

DETAILED DESCRIPTION OF THE INVENTION

Figure 1:
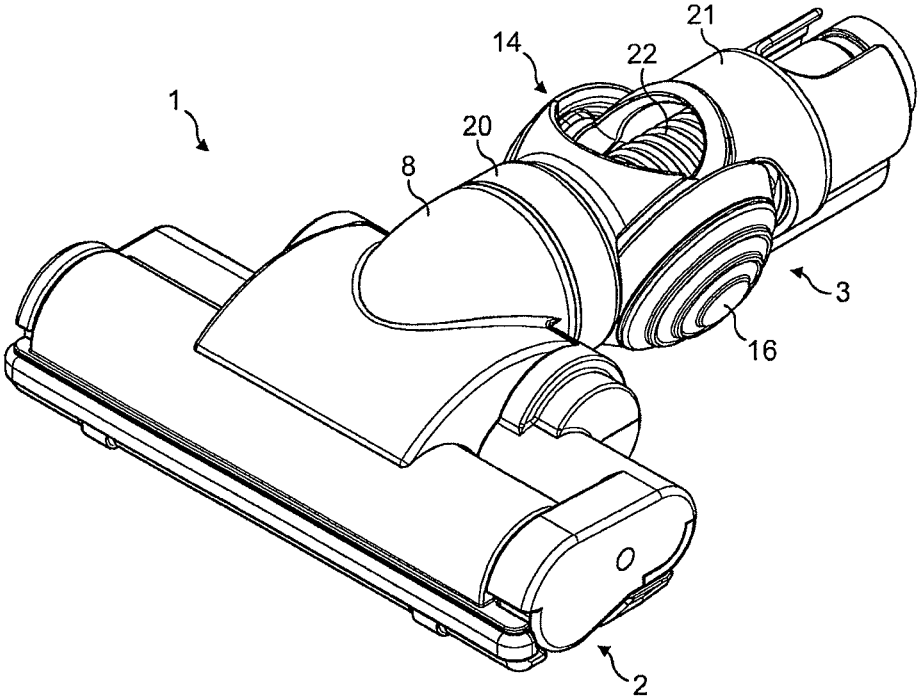
FIG. 1 illustrates a floor tool in accordance with the present invention.
Figure 2:
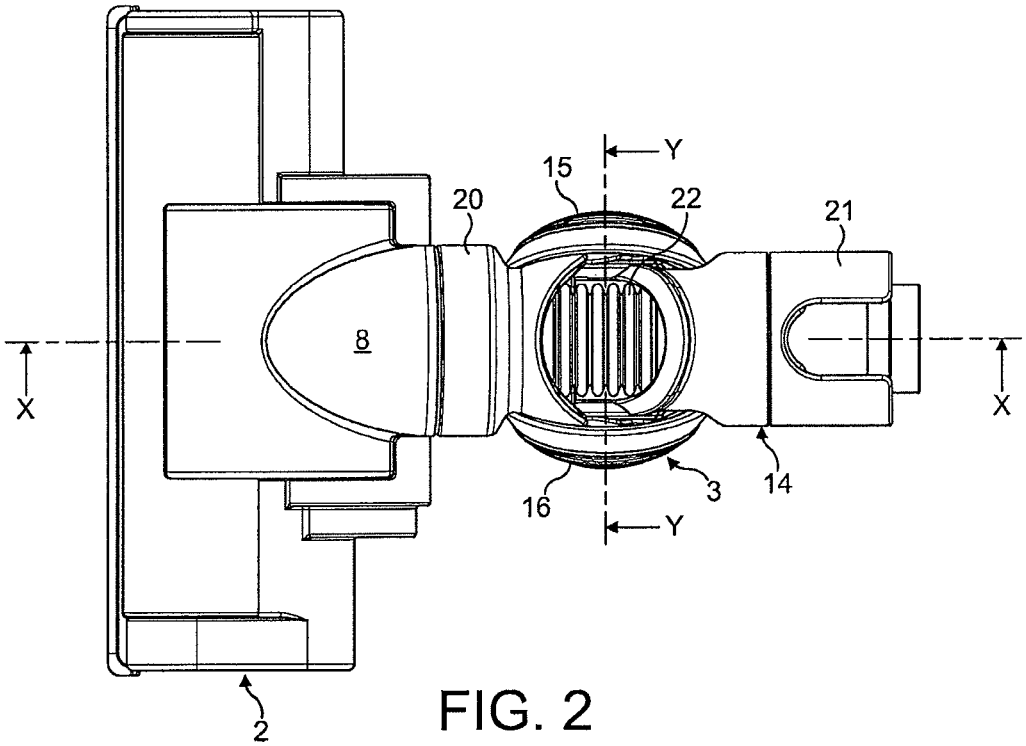
FIG. 2 is a plan view of the floor tool.
Figure 3:
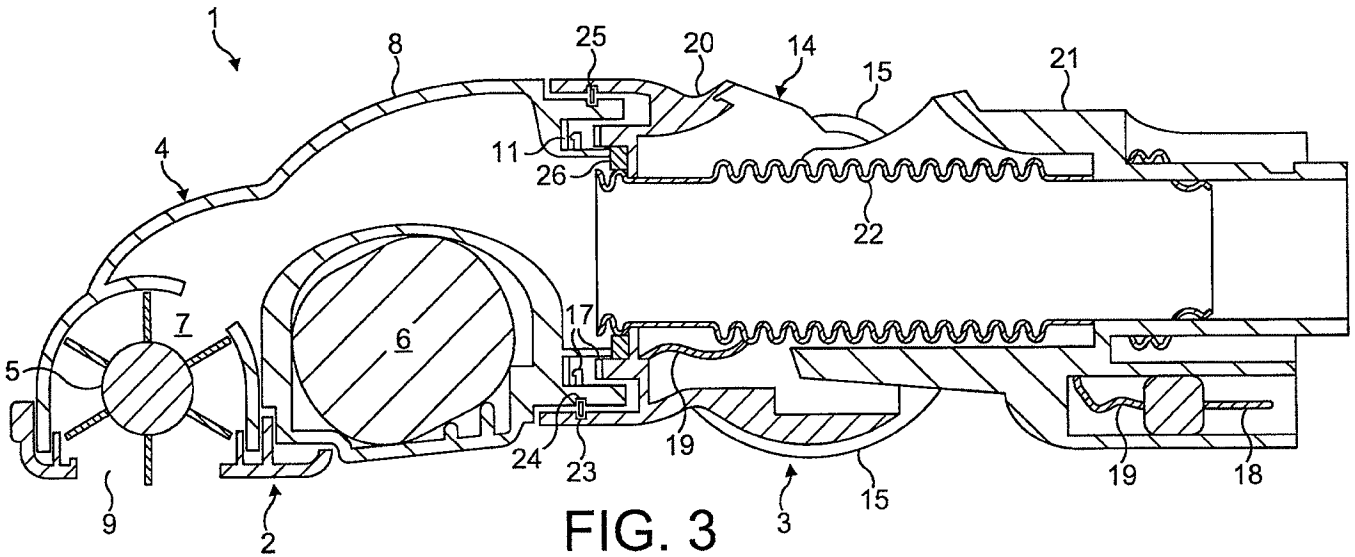
FIG. 3 is a sectional view of the floor tool taken along the line X-X as illustrated in FIG. 2.

The floor tool 1 of FIGS. 1 to 4 comprises a cleaner head 2 rotatably attached to a coupling 3. The free end of the coupling 3 is attachable to a wand, hose or other such duct of a cleaning appliance (not shown).

The cleaner head 2 comprises a housing 4, a brushbar 5 and a motor 6. The housing 4 defines a chamber 7 within which the brushbar 5 is rotatably mounted, and an outlet duct 8 that extends from the chamber 7 to the rear of the cleaner head 2. An opening 9 formed on the underside of the housing 2 provides an inlet to the chamber 7. The brushbar 5 is driven by the motor 6, which is located to the rear of the cleaner head 2 beneath the outlet duct 8. The motor 6 is coupled to an electrical terminal 11 provided at an end of the outlet duct 8, through which electrical power may be delivered to the motor 6.

The coupling 3 comprises a conduit 14 carried by a pair of wheels 15,16, an electrical terminal 17,18 provided at each end of the conduit 14, and an electrical cable 19 that extends between the electrical terminals 17,18.

The conduit 14 comprises a forward portion 20, a rearward portion 21, and a flexible hose 22.

The forward portion 20 is pivotally attached at one end to the rearward portion 21. The other end of the forward portion 20 is shaped as a cylindrical collar that receives the end of the outlet duct 8. An annular groove 23,24 is formed around each of the forward portion 20 and the outlet duct 8 into which a snap ring 25 is seated. The snap ring 25 extends between the two grooves 23,24 such that relative rotation of the forward portion 20 and outlet duct 8 is possible while relative separation is not. A gasket 26 made of resilient material (e.g. rubber or foam) is provided within the forward portion 20. The outlet duct 8, when received within the forward portion 20, abuts and compresses the gasket 26 to form a seal between the cleaner head 2 and the coupling 3. The surface of the gasket 26 is coated with a low friction material (e.g. PTFE or HDPE) such that relative rotation of the outlet duct 8 and forward portion 20 does not result in adverse wearing of the gasket 26.

One end of the rearward portion 21 is pivotally attached to the forward portion 20, while the other end is shaped for attachment to a wand, hose or other such duct of a cleaning appliance.

The hose 22 is held within and extends between the forward and the rearward portions 20,21 respectively. The hose 22 is ribbed such that the length of the hose 22 can be made to expand and contract. Consequently, as the rearward portion 21 pivots relative to the forward portion 20, the length of the hose 22 varies to accommodate the change.

Each wheel 15,16 is domed-shaped and is rotatably attached to the forward portion 20. One wheel 15 rotates about a first axis of rotation 27 and the other wheel 16 rotates about a second axis of rotation 28. The axes of rotation 27,28 are non-parallel and lie in a common plane normal to the longitudinal axis of the forward portion 20. More specifically, the first axis 27 is tiled by $+\theta$ and the second axis is tilted by $-\theta$ relative to a line 29 passing through the wheel centres, the tilt occurring in the common plane. Consequently, the two axes of rotation 27,28 intersect one another at a point that is spaced above the line 29 passing through the wheel centres. Owing to the tilt in the axes of rotation 27,28, the wheels 15,16 converge beneath the conduit 14, i.e. the separation between the wheels 15,16 is smallest beneath the conduit 14.

Figure 5:
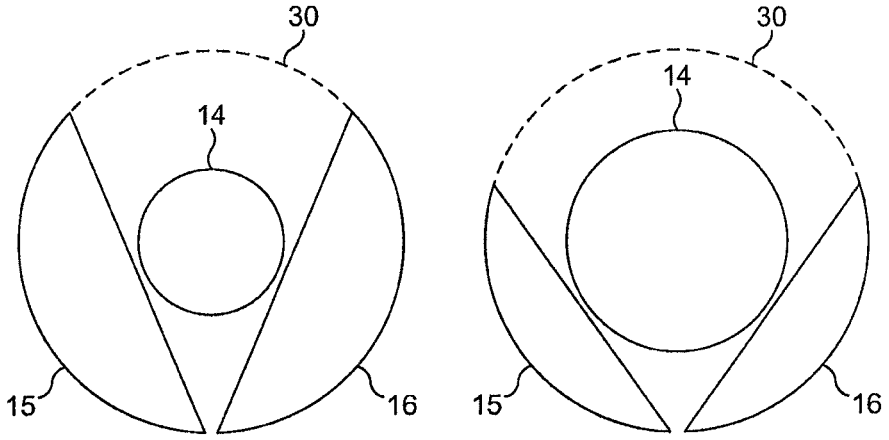
FIG. 5 illustrates simplified sectional views of floor tools having (a) a small diameter conduit, and (b) a large diameter conduit.

The curvature of each dome-shaped wheel 15,16 is spherical. Furthermore, the two wheels 15,16 are arranged (i.e. spaced from one another and tilted) such that the surfaces of the wheels 15,16 are coincident with a common sphere 30. The surfaces of the two wheels 15,16 may thus be regarded as defined by an imaginary sphere 30 from which a v-shaped wedge has been removed (this is perhaps best visualised in FIG. 5). The centre of this common sphere 30 is coincident with the longitudinal axis of the forward portion 20, the advantage of which is outlined below.

The electrical terminals 17,18 of the coupling 3 are located at the ends of the forward and rearward portions 20,21. The terminals 11,17 of the outlet duct 8 and the forward portion 20 forms a slip ring arrangement so as to permit relative rotation. The electrical cable 19 extends between and connects the terminals 17,18 of the forward and rearward portions 20,21. From the terminal 17 provided on the forward portion 20, the cable 19 extends between the forward portion 20 and the hose 22, divides in two with each half passing through a pivot formed between the forward and rearward portions 20,21, and extends between rearward portion 21 and the hose 22.

The floor tool 1 is intended to be used with a cleaning appliance that carries fluid to and/or from a surface, e.g. wet/dry vacuum cleaners, polishing/waxing machines and carpet shampoo machines. The floor tool 1 is manoeuvred over the surface to be cleaned by means of a duct of the cleaning appliance. The duct includes an electrical terminal that mates with the electrical terminal 18 provided on the rearward portion 21. Electrical power is thus delivered by the cleaning appliance to the motor 6 of the cleaner head 2, which in turn drives the brushbar 5 to agitate the cleaning surface and/or massage a fluid into the surface.

As the floor tool 1 is manoeuvred forwards and backwards, the forward portion 20 of the coupling 3 pivots relative to the rearward portion 21 such that the cleaner head 2 maintains a flat profile with the cleaning surface. Steering of the floor tool 1 is achieved by rotating the duct of the cleaning appliance, which in turn causes the rearward portion 21 of the coupling 3 to rotate about its longitudinal axis. When manoeuvring the floor tool 1, the rearward portion 21 is normally angled relative to the forward portion 20. Consequently, as the rearward portion 21 rotates about its longitudinal axis, the forward portion 20 is caused to precess about the longitudinal axis of the rearward portion 21. Owing to the weight of the cleaner head 2, as well as the pivot formed between the forward and rearward portions 20,21, rather than precessing in a cone-like manner, the forward portion 20 precesses in a plane parallel to the cleaning surface. The net result is that the cleaner head 2 moves to the right or left in response to clockwise or anticlockwise rotation of the duct of the cleaning appliance. As the cleaner head 2 moves to the right or left, the outlet duct 8 rotates relative to the forward portion 20 such that the cleaner head 2 maintains a flat profile with the cleaning surface.

As the floor tool 1 is manoeuvred forwards and backwards, the wheels 15,16 of the coupling 3 rotate to provide a rolling support for the conduit 14. In response to steering the floor tool 1, the forward portion 20 rotates about its longitudinal axis. As the forward portion 20 rotates, one of the two wheels 15,16 maintains contact with the cleaning surface and thus continues to provide rolling support for the conduit 14. The surfaces of the wheels 15,16 are coincident with a common sphere 30, the centre of which is coincident with the longitudinal axis of the forward portion 20. Consequently, as the forward portion 20 rotates about its longitudinal axis, the wheels 15,16 continue to support the forward portion 20 at the same height above the cleaning surface. No lifting of the cleaner head 2 therefore occurs and a flat profile with the cleaning surface is maintained.

The rolling support provided by the wheels 15,16 describes an arc in the plane normal to the longitudinal axis of the forward portion 20. This arcuate rolling support includes a small discontinuity at the gap between the two wheels 15,16. The discontinuity, however, is sufficiently small that, from the point of view of a user, the rolling support feels continuous.

Since the floor tool 1 is moved predominantly in a forward and backward direction, ease of movement would be greatest if both wheels 15,16 were to rotate about a single horizontal axis. However, if the wheels 15,16 were to rotate about a single horizontal axis, hemispherical wheels would be required in order to provide a continuous rolling support. Such an arrangement would leave no space for the conduit 14 to pass between the wheels 15,16. The angle by which the rotational axes 27,28 are tilted is therefore ideally as small as possible while permitting sufficient space for the conduit 14 to pass between the wheels 15,16. The angle of tilt will thus depend upon the diameter of the conduit 14 as well as the diameter of the common sphere 30 coincident with the wheel surfaces. By way of example, FIG. 7 illustrates two arrangements in which (a) a small diameter conduit 14 and (b) a large diameter conduit 14 are employed; in both arrangements, the diameter of the common sphere 30 of the wheels 15,16 is the same.

In the embodiment described above, the wheels 15,16 have axes of rotation 27,28 that lie in a common plane. However, the wheels 15,16 may toe in or out such that the axes of rotation 27,28 do not lie in a common plane. The axes of rotation 27,28 nevertheless intersect at a point spaced above the line 29 passing through the wheel centres, albeit not directly above the line 29.

Figure 4:
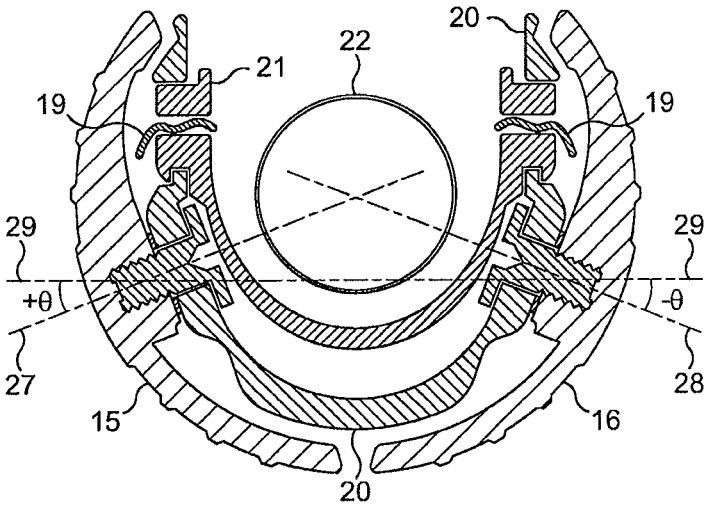
FIG. 4 is a sectional view of the floor taken along the line Y-Y as illustrated in FIG. 2.

As can be seen in FIG. 4, the rearward portion 21 is pivotally attached to the forward portion 20 at points directly above those points at which the wheels 15,16 are attached to the forward portion 20. Consequently, the overall length of the conduit 14 may be kept to a minimum, resulting in a more compact floor tool 1. Nevertheless, the points at which the rearward portion 21 attaches to the forward portion 20 may be located elsewhere.

In the embodiment described above, the cleaner head 2 includes a brushbar 5 that is driven by a motor 6. However, the cleaner head 2 may include alternative means for agitating or otherwise working a surface to be cleaned. By way of example, the brushbar 5 may be driven by an air turbine rather than a motor. Alternatively, the brushbar 5 and motor 6 may be omitted altogether from the cleaner head 2. There are therefore applications for which the electrical terminals 17,18 and cable 19 may be omitted from the coupling 3.

Wheels 15,16 having surfaces that are coincident with a common sphere 30 have the advantage that the forward portion 20 maintains the same height above the cleaning surface as the forward portion 20 rotates. Nevertheless, there may be applications for which it is advantageous to have a forward portion 20 that increases or decreases in height with rotation. Accordingly, it is not essential that the surfaces of the wheels 15,16 have spherical curvature or that the surfaces are coincident with a common sphere. Moreover, the dome-shaped wheels need not be continuously curved but may include a flat section at the wheel axes.

In the embodiment described above, the conduit 14 comprises a forward portion 20 pivotally attached to a rearward portion 21. The provision of a pivot has the advantage of ensuring that the cleaner head 2 maintains a flat profile with the cleaning surface as the floor tool 1 is manoeuvred back and forth. Nevertheless, there may be applications for which a pivot within the conduit 14 may not be necessary. By way of example, the outlet duct 8 of the cleaner head 2 may be pivotally attached to the remainder of the cleaner head 2. In this instance, the conduit 14 may be formed as a unitary element having an elbow or bend such that rotation of the conduit 14 continues to bring about steering of the cleaner head 2.

While the cleaner head 2 and the coupling 3 are attached in a manner that is intended to prevent their separation, the two may be adapted for separable attachment. The coupling 3 may then be used with different cleaner heads to form a floor tool 1. Moreover, while the coupling 3 is intended to be releasably attached to a duct of a cleaning appliance, the coupling 3 may alternatively form an integral part of the cleaning appliance. The cleaning appliance may then be used with different, interchangeable cleaner heads.

Conventional floor tools often include wheels that aid in manoeuvring the floor tool. However, movement of the floor tool is typically constrained to that along a straight line. In contrast, the floor tool 1 of the present invention can be manoeuvred in directions beyond that of a straight line.

Floor tools capable of movement beyond a straight line are known. In one example, a pair of wheels is arranged on opposite sides of a conduit attached to a cleaner head. The wheels rotate about a common horizontal axis such that, when steering the floor tool, one of the wheels lifts off the cleaning surface. Additionally, the conduit rocks to one side causing the height of the conduit above the cleaning surface to increase. This in turn causes the rear of the cleaner head to lift off the cleaning surface resulting in loss of performance. Furthermore, the lifting of the cleaner head places a strain on the arm of the user and thus repeated steering of the floor tool can become tiring. In a further example, a cleaner head is attached to a conduit carried by three wheels. A barrel-shaped wheel sits below the conduit and two larger wheels are located on opposite sides of the conduit. This arrangement has the advantage that, as the floor tool is steered left or right, the height of the conduit above the cleaning surface is unchanged and thus the cleaner head maintains a flat profile with the surface. Nevertheless, the floor tool is relatively bulky owing to the presence of three wheels. In particular, since the conduit sits on top of the barrel-shaped wheel, the height of the floor tool is relatively high. Additionally, the provision of three wheels increases the weight and cost of the floor tool.

With the floor tool of the present invention, a substantially continuous rolling support is provided by two wheels only. Accordingly, the floor tool is both lighter and cheaper than the aforementioned floor tool having three wheels. Moreover, the conduit of the floor tool passes between, rather than over, the wheels and thus the floor tool is more compact. In particular, the floor tool is of lower height, making it well-suited at cleaning beneath structures of particularly low profile. As the floor tool is steered to the left or right, the conduit (or at least that portion of the conduit attached to the cleaner head) maintains the same height above the cleaning surface. Consequently, the cleaner head maintains a flat profile with the cleaning surface and no loss of performance occurs. Additionally, in comparison to the aforementioned floor tool having two wheels, less effort is required on the part of the user to steer the floor tool. Furthermore, the floor tool is capable of tighter turns.

The invention claimed is:

1. A floor tool for a cleaning appliance comprising a cleaner head rotatably attached to a conduit carried by a pair of wheels that converge beneath the conduit, wherein the wheels have axes of rotation that intersect above a line passing through the wheel centres.

2. The floor tool of claim 1, wherein the wheels are separated beneath the conduit by a gap that subtends an angle at a centre of the conduit by no more than 20 degrees.

3. The floor tool of claim 1, wherein the wheels have surfaces of spherical curvature.

4. The floor tool of claim 1, wherein the wheels have surfaces coincident with a common sphere.

5. The floor tool of claim 1, wherein the wheels are dome-shaped.

6. The floor tool of claim 1, wherein the wheels provide a substantially continuous arcuate support in a plane normal to a longitudinal axis of the conduit.

7. The floor tool of claim 4, wherein the conduit has a longitudinal axis that is coincident with the centre of the common sphere.

8. The floor tool of claim 1, wherein the conduit comprises a forward portion pivotally attached to a rearward portion, the cleaner head is rotatably attached to the forward portion, and the wheels are rotatably attached to the forward portion.

9. The floor tool of claim 8, wherein the wheels are attached to the forward portion at a first set of points, and the rearward portion is attached to the forward portion at a second set of points located above the first set of points.

10. A floor tool for a cleaning appliance comprising a cleaner head rotatably attached to a conduit carried by a pair of dome-shaped wheels, the wheels having axes of rotation that are oriented such that the wheels converge beneath the conduit.

11. The floor tool of claim 10, wherein the wheels provide a substantially continuous arcuate support in a plane normal to a longitudinal axis of the conduit.

12. The floor tool of claim 10, wherein the wheels are separated beneath the conduit by a gap that subtends an angle at a centre of the conduit by no more than 20 degrees.

13. The floor tool of claim 10, wherein the wheels have surfaces of spherical curvature.

14. The floor tool of claim 10, wherein the wheels have surfaces coincident with a common sphere.

15. The floor tool of claim 10, wherein the conduit comprises a forward portion pivotally attached to a rearward portion, the cleaner head is rotatably attached to the forward portion, and the wheels are rotatably attached to the forward portion.

16. A floor tool for a cleaning appliance comprising a cleaner head rotatably attached to a conduit carried by two wheels only that converge beneath the conduit.

17. The floor tool of claim 16, wherein the wheels are dome-shaped.

18. The floor tool of claim 16, wherein the wheels provide a substantially continuous arcuate support in a plane normal to a longitudinal axis of the conduit.

19. The floor tool of claim 16, wherein the conduit comprises a forward portion pivotally attached to a rearward portion, the cleaner head is rotatably attached to the forward portion, and the wheels are rotatably attached to the forward portion.

20. The floor tool of claim 19, wherein the wheels are attached to the forward portion at a first set of points, and the rearward portion is attached to the forward portion at a second set of points located above the first set of points.

* * * * *